US011655012B2

(12) United States Patent
Rosenthal et al.

(10) Patent No.: US 11,655,012 B2
(45) Date of Patent: May 23, 2023

(54) DROP WEIGHT BUOYANCY SYSTEM FOR UNDERWATER GLIDERS

(71) Applicant: RAYTHEON BBN TECHNOLOGIES, CORP., Cambridge, MA (US)

(72) Inventors: Benjamin Jacob Rosenthal, Newport, RI (US); James Joseph Stusse, Middletown, RI (US)

(73) Assignee: RAYTHEON BBN TECHNOLOGIES CORP., Cambridge, MA (US)

( * ) Notice: Subject to any disclaimer, the term of this patent is extended or adjusted under 35 U.S.C. 154(b) by 7 days.

(21) Appl. No.: 17/507,540

(22) Filed: Oct. 21, 2021

(65) Prior Publication Data

US 2023/0041341 A1 Feb. 9, 2023

Related U.S. Application Data

(60) Provisional application No. 63/229,927, filed on Aug. 5, 2021.

(51) Int. Cl.
*B63G 8/18* (2006.01)
*B63G 8/20* (2006.01)

(52) U.S. Cl.
CPC *B63G 8/18* (2013.01); *B63G 8/20* (2013.01)

(58) Field of Classification Search
CPC ... B63G 8/00; B63G 8/14; B63G 8/18; B63G 8/20; B63G 8/22; B63G 8/24; B63G 8/26
USPC ..... 114/312, 313, 317, 321, 328, 330, 331, 114/333
See application file for complete search history.

(56) References Cited

U.S. PATENT DOCUMENTS

| | | | | |
|---|---|---|---|---|
| 4,301,761 | A | 11/1981 | Fry et al. | |
| 5,291,847 | A * | 3/1994 | Webb | F03G 7/05 441/21 |
| 8,205,570 | B1 * | 6/2012 | Tureaud | B63G 8/14 114/330 |
| 8,875,645 | B1 * | 11/2014 | Webb | G01C 13/00 441/32 |
| 10,661,623 | B2 * | 5/2020 | Edwards | B63G 8/001 |

FOREIGN PATENT DOCUMENTS

| | | | | |
|---|---|---|---|---|
| CN | 111 907 670 | A | 11/2020 | |
| GB | 2428994 | A * | 2/2007 | B63G 8/22 |
| WO | WO 2015/127244 | A1 | 8/2015 | |

OTHER PUBLICATIONS

International Search Report dated Sep. 29, 2022 for corresponding PCT Application No. PCT/US2022/028835 (7 pages).
Written Opinion dated Sep. 29, 2022 for corresponding PCT Application No. PCT/US2022/028835 (10 pages).

* cited by examiner

*Primary Examiner* — Daniel V Venne
(74) *Attorney, Agent, or Firm* — Lewis Roca Rothgerber Christie LLP

(57) ABSTRACT

A pump-less buoyancy engine for an autonomous underwater vehicle (AUV) includes a buoyancy reduction structure without a hydraulic pump for reducing the buoyancy of the AUV to cause the AUV to descend in the water; and a weight dropping structure for dropping prepackaged weights out of the AUV to cause the AUV to ascend in the water, where the AUV moves forward when descending and ascending.

15 Claims, 5 Drawing Sheets

DROP WEIGHT BUOYANCY SYSTEM FOR UNDERWATER GLIDERS

CROSS-REFERENCE TO RELATED APPLICATIONS

This Patent Application claims the benefits of U.S. Provisional Patent Application Ser. No. 63/229,927, filed on Aug. 5, 2021, and entitled "Drop Weight Buoyancy System for Underwater Gliders," the entire content of which is hereby expressly incorporated by reference.

FIELD OF THE INVENTION

The disclosed invention relates generally to autonomous underwater vehicles (AUV) and more specifically to drop weight buoyancy system and method for underwater gliders.

BACKGROUND

An autonomous underwater vehicle (AUV) is a vehicle that travels underwater without requiring input from an operator in the vehicle. AUVs are typically controlled and powered from the surface by an operator via cable connection or using wireless remote control. Underwater gliders are a subclass of AUVs, which have recently become attractive for underwater search, research and exploration, such as, long-term data collection in oceanography and coastal management, since they are cheaper than manned vehicles. AUVs have also been used to find wreckages of objects under water, for example missing airplanes and ships. AUVs are also used in military applications, such as intelligence, surveillance, and reconnaissance, mine countermeasures, anti-submarine warfare, inspection/identification of targets, communication/navigation network nodes, payload delivery, information operations, and the like.

An underwater glider is a type of AUV that employs variable-buoyancy propulsion (engine) instead of traditional propellers or thrusters. It employs variable buoyancy in a similar way to a profiling float, but unlike a float, which can move only up and down, an underwater glider is fitted with hydrofoils (underwater wings) that allow it to glide forward while descending through the water. At a certain depth, the glider switches to positive buoyancy to climb back up and forward, and the cycle is then repeated.

A buoyancy engine is a device that alters the buoyancy of a vehicle or object, to move it vertically, or provide forward motion by providing variable-buoyancy propulsion, such as with underwater gliders. For underwater applications, buoyancy engines typically involve a hydraulic pump that either inflates and deflates an external bladder filled with hydraulic fluid, or extends and retracts a rigid plunger. FIG. 1 shows a typical buoyancy engine that uses a high-pressure pump (including a battery) to pump water, oil or air (controlled by a valve) into an external bladder from an internal reservoir and therefore change the buoyancy of the vehicle.

The change in the vehicle's total volume alters its buoyancy, making it move upward or sink as required. In doing so, the density of the vehicle that the engine is installed on changes. As a result, an AUV, such as an underwater glider, can adjust its buoyancy and therefore move without traditional propulsion methods. This allows the glider to remain in operation, using a liquid-pump or chemical means for controlling buoyancy. The underwater glider works similarly to how a glider in air works. It utilizes the flow of fluid, in this case water, over a set of wings to generate lift and thrust. Weight is permanently installed and distributed within the underwater glider, putting the center of gravity (CG) at the front of the leading edge of the wings, which results in an efficient and smooth glide slope. The buoyancy engine allows an underwater glider to continue the gliding process for extended periods of time by cycling up and down glide angles over the course of the vehicle's operational life.

Without a buoyancy engine, typically an underwater glider would either have to be towed by a surface vessel or only be used once and deploy a package that would float to the surface where it can be retrieved. With the addition of a buoyancy engine, the underwater glider becomes a viable tool as it can stay in operation longer and can be reused.

Gliders are effective at operating at relatively low noise compared to other AUVs. However, by removing the hydraulic-pump or any chemical means for controlling buoyancy, the noise drops below the ambient deep-water noise floor. However, to remove the hydraulic-pump or the chemical means, a different system and method for adjusting buoyancy, CG, and center of buoyancy (CB) is needed.

SUMMARY

Present disclosure is directed to a method and a system for adjusting buoyancy, CG, and CB without using a noisy and energy consuming hydraulic-pump. Rather, the disclosure controls trim and pitch via the release of weights and reducing buoyancy and a mechanism for moving/sliding the masses and buoyancy after each deployment.

In some embodiment, the disclosure describes a pump-less buoyancy engine for an autonomous underwater vehicle (AUV). The pump-less buoyancy engine includes a buoyancy reduction structure without a hydraulic pump for reducing the buoyancy of the AUV to cause the AUV to descend in the water; and a weight dropping structure for dropping prepackaged weights out of the AUV to cause the AUV to ascend in the water, wherein the AUV moves forward when descending and ascending.

In some embodiment, the buoyancy reduction structure includes a water inlet/outlet and a container, and the buoyancy of the AUV is reduced by intaking water from the water inlet/outlet into the container, where air or high-pressure gas is let out through an air outlet and is replaced by the intaking water in the container. The buoyancy reduction structure may further include a valve and a flow meter, where intaking water is controlled by the valve to control a desired depth of the AUV, and the valve is controlled by a controller.

In some embodiment, the weight dropping structure includes a heavy weight wiring and a cutter to cut a portion of the wire, where the cut portion of the wire is dropped from an opening into the water. In some embodiment, the weight dropping structure may further include a wire feeder, and a spring secured to the AUV at one end and coiled around a pully system at another end, where the heavy weight wiring is fed by the feeder, and a break with an encoder measures a fixed length of the wire to drop the cut portion from the opening in the water.

BRIEF DESCRIPTION OF THE DRAWINGS

A more complete appreciation of the disclosed invention, and many of the attendant features and aspects thereof, will become more readily apparent as the disclosed invention becomes better understood by reference to the following detailed description when considered in conjunction with the accompanying drawings in which like reference symbols indicate like components.

DETAILED DESCRIPTION

In some embodiments, the system and method use weights and buoyancy to control density and buoyancy centers away from their respective neutral positions, while also controlling trim. The disclosure does not use a hydraulic pump or chemical means for controlling buoyancy. Prepackaged weights, such as sand, lead and other types of weights, and buoyant compartments are used to control the percent away from neutral positions. In some embodiments, at each travel cycle, the AUV drops either a weight or a volume that is lighter than the surrounding water, shifting CB and buoyancy around neutral. This greatly increases the speed of the glider over hydraulically pumped systems by moving farther from neutrally buoyant. The system and method of the disclosure controls trim via the release of the weights and buoyancy and a simple mechanism for sliding the masses and buoyancy after each deployment. This differs from existing systems that have secondary systems to control the trim.

Figure 1:
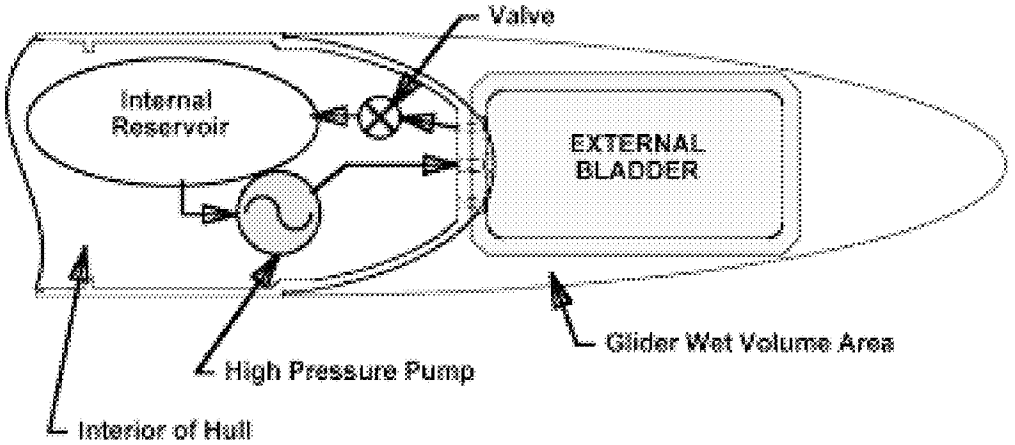
FIG. 1 PRIOR ART
FIG. 1 shows a typical buoyancy engine.
Figure 2:
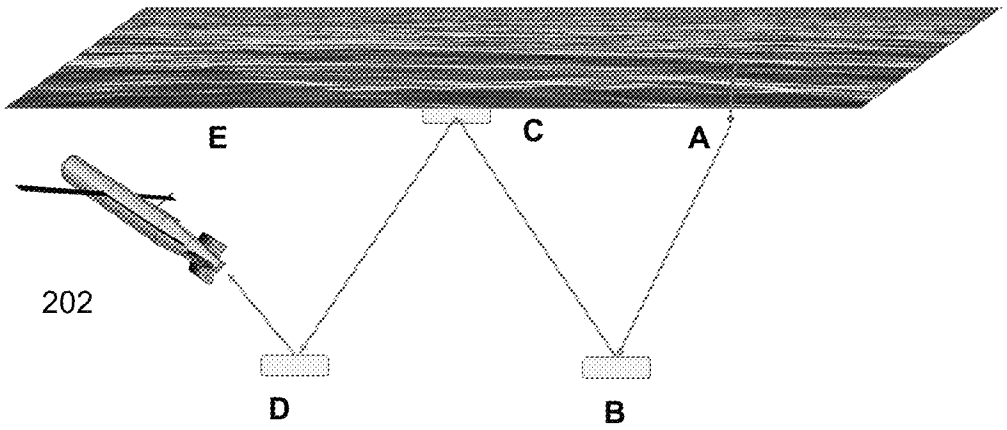
FIG. 2 illustrates operation of an underwater vehicle using a buoyancy engine, without a pump, according to some embodiments of the disclosure.

FIG. 2 illustrates operation of an underwater vehicle using weights and buoyancy, without a pump, according to some embodiments of the disclosure. When AUV 202 equipped with a pump-less buoyancy engine is deployed, the vehicle increases its density to sink beneath the surface of the water and to reach an appropriate (desired) depth to start its operation. Once at the appropriate depth, the vehicle begins its operation and the buoyancy engine adjusts the density to a value that is most efficient for gliding. When a predetermined depth has been achieved, the buoyancy engine decreases density causing the glider to glide up towards the surface (or a desired height). This way, the AUV remains in operation between two preset depths.

As shown in FIG. 2, AUV 202 sequentially drops weights and buoyancy to achieve the variations around neutral needed to move through the water. At the launch of the vehicle (point A), the vehicle 202 is heavier than a neutral buoyancy. As known in the art, neutral buoyancy occurs when an object's average density is equal to the density of the fluid in which it is immersed (in this case, water), resulting in the buoyant force balancing the force of gravity that would otherwise cause the object to sink (if the body's density is greater than the density of the fluid in which it is immersed) or rise, if the density is less. An object that has neutral buoyancy neither sinks nor rises.

At the top of a glide path (points A and C), buoyancy is dropped (as described with respect to FIGS. 3-5) from the bow causing the vehicle 202 to pitch down at the nose and sink. In some embodiments, at the top of each leg of travel, a buoyancy compartment is flooded with water that causes the buoyancy to drop, for example, similar to a submarine ballast tank. At the bottom of a glide path (points B and D), weight is released (as described with respect to FIGS. 3-5) from the bow causing the vehicle to pitch up at the nose and rise. This process is repeated for the path of travel. In some embodiments, each time a weight or buoyant mass is released, the remaining masses are shifted closer to the bow. Since the pump-less buoyancy engine of the preset disclosure allows the vehicle 202 to change its density, it can glide in two directions. It can glide down like a normal glider, or it can glide up if it makes itself less dense than the water around it. In this way, as long as the buoyancy engine remains active, the vehicle can continue to operate, and travel forward by trimming the airfoil-shaped wings.

Figure 3A:
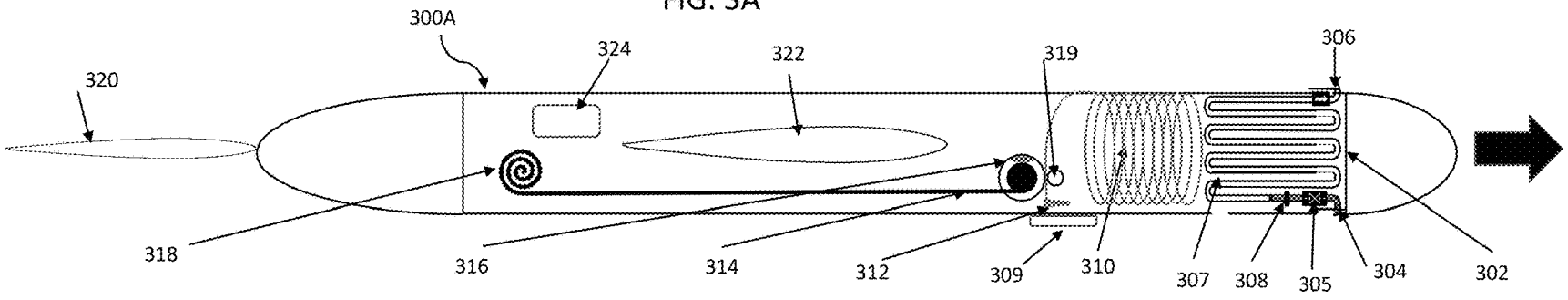
FIG. 3A depicts a pump-less buoyancy engine with wired weight and air release, according to some embodiments of the disclosure.

FIG. 3A depicts a pump-less buoyancy engine with wired weight and air release, according to some embodiments of the disclosure. As shown, an AUV 300A includes a buoyancy reduction structure 302 without a hydraulic pump, and a weight drop/reduction structure including heavy weight wiring 310, such as lead wires. The buoyancy is reduced by intaking water in the environment (for example ocean water) from a water inlet/outlet 304 into a container 305. The air in the container 307 is let out from an air outlet 306 and is replaced by water in the container 307 resulting in an increase in the mass of the AUV 300A. This reduces the buoyancy of the AUV 300A causing it to dive.

The water intake is controlled by a valve 305 to control the desired depth of the AUV. For example, a flow meter 308 measures the flow and amount of the water taken in and once the AUV reaches the desire depth, it closes the valve. The valve is controlled by the electronics 324 inside the AUV (for example, by a program executed by a controller 324), or remotely from outside of the vehicle, similar to the known methods.

Once the AUV 300A reaches the desired depth, a portion (snip) 312 of the heavy weight wiring 310 is cut and dropped from an opening 309 into the environment water resulting in a mass reduction of the vehicle causing the vehicle to ascend (climb up). In some embodiments, the heavy weight wiring 310, such as lead wiring, is fed/moved by a feeder including a spring 314 secured to the vehicle at one end 318 and coiled around a pully system 316. The pully system 316 includes a cutter 319 and a break with an encoder to (mechanically) measure a fixed length of the wire, cut the wire and drop the cut portion from the opening 309. Although, the disclosure of FIG. 3A uses air as an example, one skilled in the art would recognize that high-pressure gas may be used instead of air.

As known in the art the hydro-foil-shaped wings 322 (one is shown for simplicity) cause the AUV 300A to move forward when it is descending (diving) and ascending (climbing). The steering of the vehicle may be accomplished by (e.g., remotely) controlling a rudder 320 at the tail end of the vehicle, as known in the art.

Figure 3B:
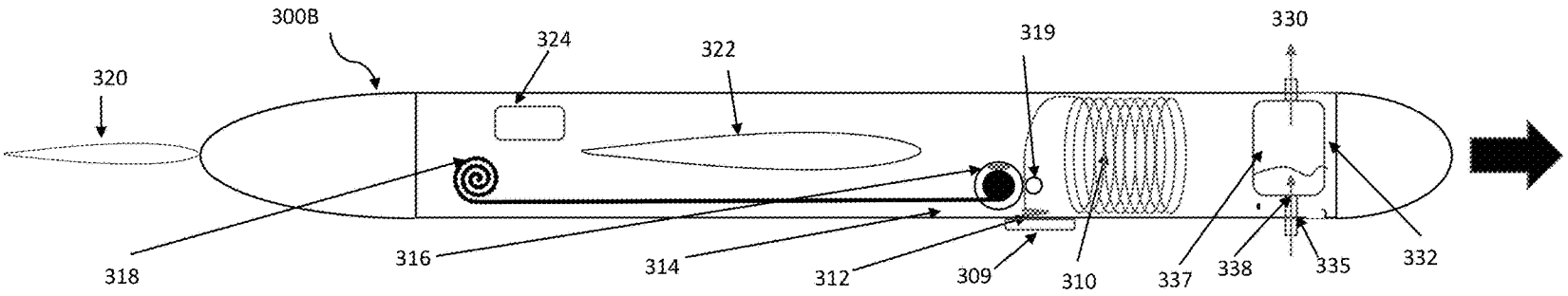
FIG. 3B shows a pump-less buoyancy engine with wired weight and high-pressure gas release, according to some embodiments of the disclosure.

FIG. 3B shows a pump-less buoyancy engine with wired weight and high-pressure gas release, according to some embodiments of the disclosure. As shown, the weight drop/reduction structure that includes a heavy weight wiring 310 of the AUV 300B is similar to that in FIG. 3A. However, the buoyancy reduction structure 332 without a hydraulic pump, includes a container 337 of high-pressure gas, such as nitrogen that is let inout at an outlet 330. The gas is partially replaced by water in the container 337 resulting in an increase in the mass of the AUV 300A, similar to that of AUV 300A, in FIG. 3A.

The water intake is controlled by a valve 335 to control the desired rate of dive of the AUV. Similar to that of AUV 300A, in FIG. 3A, a flow meter 338 measures the flow and amount of the water taken in and once the AUV 300B reaches the desire depth, it closes the valve. The valve is controlled by the electronics inside the AUV (for example, by a program executed by a controller 324), or remotely from outside of the vehicle, similar to the known methods. Although, the description of FIG. 3B uses high-pressure gas as an example, one skilled in the art would recognize that air may be used instead of high-pressure gas.

Figure 4A:
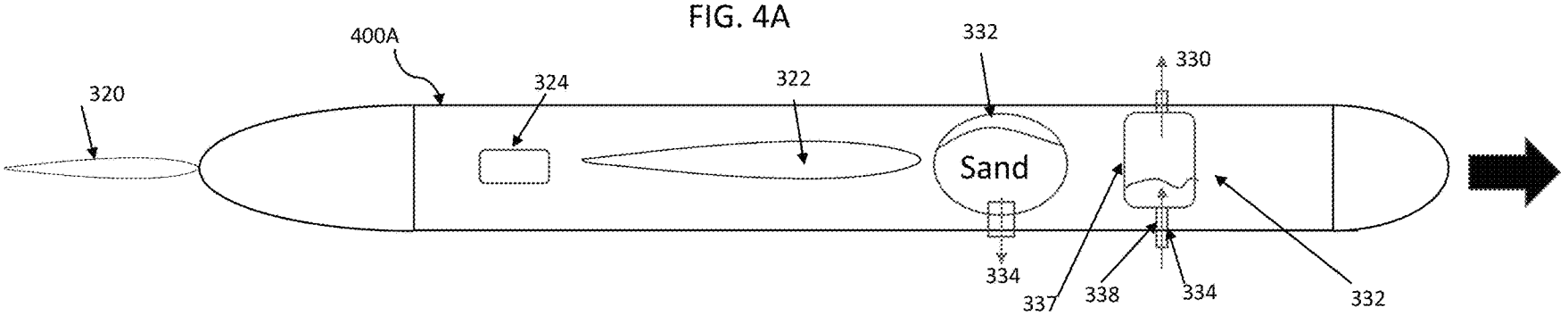
FIG. 4A depicts a pump-less buoyancy engine with granular weight and air release, according to some embodiments of the disclosure.

FIG. 4A depicts a pump-less buoyancy engine with granular weight and air release, according to some embodiments of the disclosure. As depicted, the buoyancy reduction structure 332 is similar to stricture 332 in FIG. 3B. However, the weight reduction is performed by dispensing a granular weight, such as sand, from a container 332 through an opening with a valve 334. The valve is controlled by the electronics 324 inside the AUV 400A (for example, by a program executed by a controller 324), or remotely from outside of the vehicle, to dispense a predetermined amount of the granular weight (e.g., sand) at the bottom of the travel path. This mass reduction cases the AUV 400A to ascend (climb up).

Figure 4B:
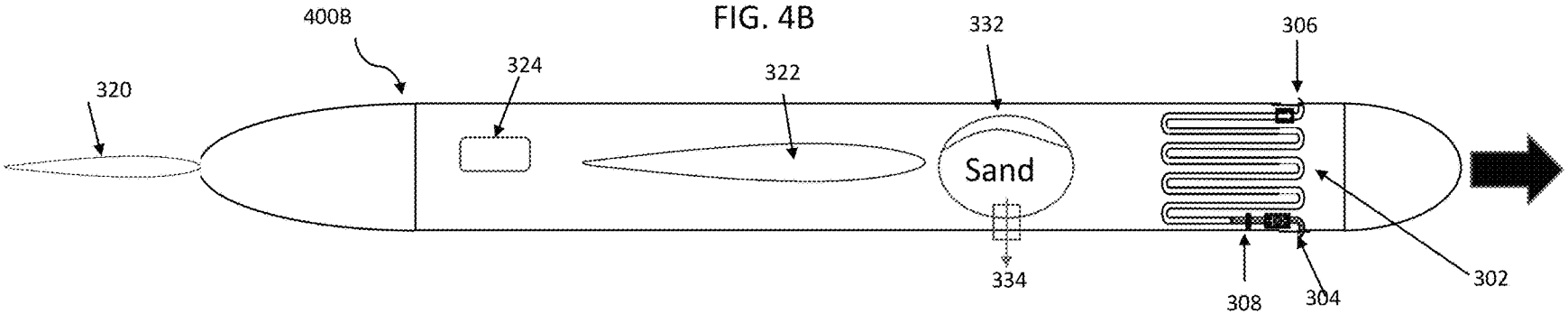
FIG. 4B shows a pump-less buoyancy engine with granular weight and high-pressure gas release, according to some embodiments of the disclosure.

FIG. 4B shows a pump-less buoyancy engine with granular weight and high-pressure gas release, according to some embodiments of the disclosure. As shown the weight drop/reduction structure that includes granular weight (e.g., sand) is similar to that in FIG. 4A. However, the buoyancy reduction structure 332 without a hydraulic pump, includes a container 337 of high-pressure gas that is let out at an outlet 330, similar to that in FIG. 3A. This way, the gas is replaced by water in the container 337 resulting in a decrease in the buoyancy of the AUV 400B. This buoyancy reduction cases the AUV 400B to descend (dive).

As known in the art the hydro-foil-shaped wings 322 (one is shown for simplicity) cause the AUVs 400A and 400B to move forward when it is descending (diving) and ascending (climbing). The steering of the vehicle may be accomplished by (e.g., remotely) controlling a rudder 320 at the tail end of the vehicle, as known in the art.

Figure 5:
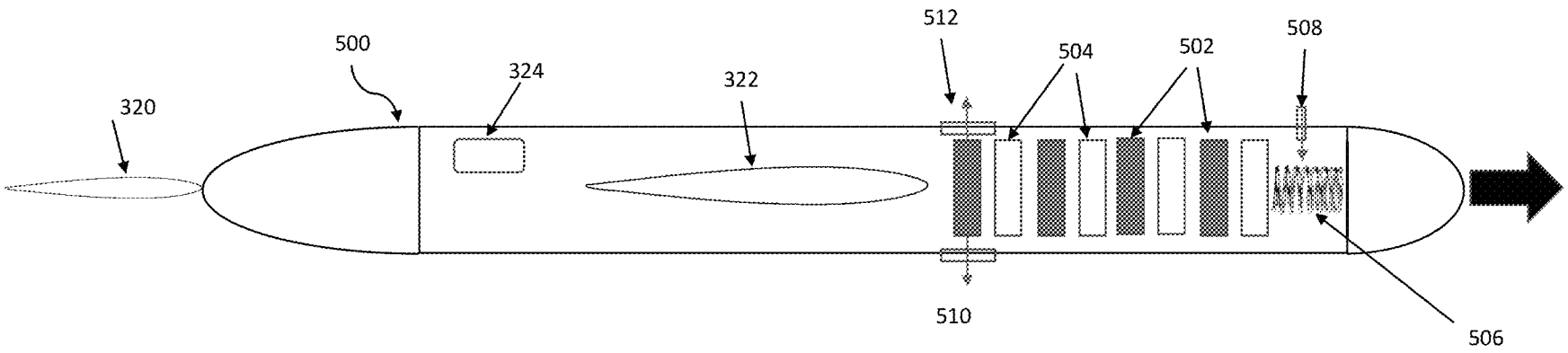
FIG. 5 illustrates a pump-less buoyancy engine with solid weight release, according to some embodiments of the disclosure.

FIG. 5 illustrates a pump-less buoyancy engine with solid weight release, according to some embodiments of the disclosure. As illustrated, an AUV 500 includes buoyancy reduction and weight drop/reduction structures, without using a hydraulic pump. The weight drop/reduction structure includes heavier solid weights 502 and lighter weights or empty chambers 504. While at the surface or a desired height, the buoyancy is set with a predetermined mass of weights (502 and 504) to take the AUV 500 to a desired depth.

At the desired depth, the buoyancy is increased by dropping a weight 502 by a tension force structure 506, for example, a spring, shifting the weight 502 towards and dropping it through an opening 510. Alternatively, the weight 502 may already be over the (closed) opening 510 and at the appropriate time (depth), the opening 510 opens to drop the weight 502. The weights are then shifted forward (with respect to the opening) via the tension force structure 506 to be situated/positioned for the next drop. As a result, the mass of vehicle 500 is reduced and its buoyancy is increased causing the vehicle to ascend (climb up).

Once at the desired height in the water, the empty slot of the dropped weight 502 (or adjacent empty slot 504) is filled with water via a water inlet/outlet 512 and the air in the empty slot is let out from an air outlet 508 resulting in an increase in the mass of the AUV 500. This reduces the buoyancy of the AUV causing it to dive and submerge. In some embodiments, the water intake may be controlled by a valve operated by the electronics 324 inside the AUV 500 to direct it to the desired depth. Again, the hydro-foil-shaped wings 322 cause the AUV 500 to move forward when it is descending (diving) and ascending (climbing). The steering of the vehicle may be accomplished by operating a rudder 320 at the tail end of the vehicle, as known in the art.

As known, one way to release buoyancy and take in water is to release some light weight that takes up space, such as, a plastic container/tube or glass sphere filled with gas. In some embodiments, lighter weights or empty chambers 504 are released to release buoyancy.

The system of the present disclosure does not use a liquid-pump or chemical means for controlling buoyancy. As described above, prepackaged weights and buoyant compartments are used to control the percent away from neutral CG and CB. This increases the speed of the vehicle by moving farther from neutrally buoyant since a glider's speed is directly proportional to the amount of lift generated by the wings. The lift of the wings is, in turn, proportional to the speed of the flow around the wings squared. By falling or rising faster, the amount of lift is increased thus increasing the amount of thrust.

The range of the vehicle is also increased because of the proportionally high energy storage in the potential energy of stored weight and volume compared to the electrical energy of batteries. Further, the noise level is significantly decreased, due to lack of a pump. Operating at speed under the ambient noise floor will reduce likelihood of detection or force an adversary to spend increased resources to locate. Additionally, air drops of the AUV are possible because of lack of fragile moving parts. Also, controlled variations from neutral CG and CB are not limited, noting that the traditional pumped systems cannot exceed their volume for moving mass and CG limiting their potential rate of rise/fall.

It will be recognized by those skilled in the art that various modifications may be made to the illustrated and other embodiments of the invention described above, without departing from the broad inventive scope thereof. It will be understood therefore that the invention is not limited to the particular embodiments or arrangements disclosed, but is rather intended to cover any changes, adaptations or modifications which are within the scope and spirit of the invention as defined by the appended claims and drawings.

The invention claimed is:

1. A pump-less buoyancy engine for an autonomous underwater vehicle (AUV) comprising:

a buoyancy reduction structure without a hydraulic pump for reducing the buoyancy of the AUV to cause the AUV to descend in water; and a weight dropping tension force structure for dropping prepackaged weights out of the AUV to cause the AUV to ascend in the water, wherein the AUV moves forward when descending and ascending, wherein the weight dropping tension force structure further comprises a weight wiring and a cutter to cut a portion of the wire, wherein the cut portion of the wire is dropped from an opening into the water.

2. The pump-less buoyancy engine of claim 1, wherein the buoyancy reduction structure includes a water inlet/outlet and a container, and wherein the buoyancy of the AUV is reduced by intaking the water from the water inlet/outlet into the container.

3. The pump-less buoyancy engine of claim 1, further comprising buoyant compartments to control the buoyancy away from its neutral positions.

4. The pump-less buoyancy engine of claim 2, wherein air is let out through an air outlet and is replaced by the intaking the water in the container.

5. The pump-less buoyancy engine of claim 2, wherein a pressurized gas is let out through a gas outlet and is replaced by the intaking the water in the container.

6. The pump-less buoyancy engine of claim 2, wherein the buoyancy reduction structure further includes a valve and a flow meter, and wherein intaking the water is controlled by the valve to control a desired depth of the AUV, and the valve is controlled by a controller.

7. The pump-less buoyancy engine of claim 1, wherein the weight dropping tension force structure further comprises a wire feeder, and a spring secured to the AUV at one end and coiled around a pully system at another end, wherein the weight wiring is fed by the feeder, and a break with an encoder measures a fixed length of the wire to drop the cut portion from the opening in the water.

8. The pump-less buoyancy engine of claim 7, wherein the weight wiring is lead wiring.

9. The pump-less buoyancy engine of claim 1, wherein the weight dropping tension force structure further comprises a container including a granular weight, wherein the granular weight is dropped from a container through an opening with a valve.

10. The pump-less buoyancy engine of claim 9, wherein the valve is controlled by a controller.

11. The pump-less buoyancy engine of claim 1, wherein the weight dropping structure comprises solid weights, wherein the buoyancy is reduced by dropping a solid weight through an opening.

12. The pump-less buoyancy engine of claim 11, wherein the weight dropping tension force structure produces a tension force to shift weights to be positioned for a next drop.

13. The pump-less buoyancy engine of claim 11, wherein the buoyancy reduction structure comprises one or more empty slots, wherein the one or more empty slots are filled with the water via a water inlet/outlet and air in the one or more empty slots is let out from an air outlet.

14. An autonomous underwater vehicle (AUV) comprising:

a buoyancy reduction structure without a hydraulic pump for reducing the buoyancy of the AUV to cause the AUV to descend in water;

a weight dropping tension force structure for dropping prepackaged weights out of the AUV to cause the AUV to ascend in the water, wherein the weight dropping tension force structure further comprises a weight wiring and a cutter to cut a portion of the wire, wherein the cut portion of the wire is dropped from an opening into the water;

one or more hydrofoils for causing the AUV to move forward when descending and ascending; and a rudder to steer the AUV.

15. The AUV of claim 14 further comprising a controller to control the movement of the AUV.

* * * * *